United States Patent [19]

Dolkemeyer et al.

[11] Patent Number: 4,494,960

[45] Date of Patent: Jan. 22, 1985

[54] PROCESS FOR THE PRODUCTION OF PUMPABLE COAL SLURRIES

[75] Inventors: Wilfried Dolkemeyer, Bornheim-Udorf; Karl-Heinz Keim; Ewald Meisenburg, both of Heimerzheim, all of Fed. Rep. of Germany

[73] Assignee: Rheinische Braunkohlenwerke AG, Stuttgenweg, Fed. Rep. of Germany

[21] Appl. No.: 626,597

[22] PCT Filed: Dec. 3, 1981

[86] PCT No.: PCT/DE81/00211

§ 371 Date: Aug. 4, 1982

§ 102(e) Date: Aug. 4, 1982

[87] PCT Pub. No.: WO82/02056

PCT Pub. Date: Jun. 24, 1982

Related U.S. Application Data

[63] Continuation of Ser. No. 406,247, Aug. 4, 1982, abandoned.

[30] Foreign Application Priority Data

Dec. 8, 1980 [DE] Fed. Rep. of Germany ..... 3046248

[51] Int. Cl.[3] ..... C10L 1/18

[52] U.S. Cl. ..... 44/51

[58] Field of Search ..... 44/51

[56] References Cited

U.S. PATENT DOCUMENTS

| | | | |
|---|---|---|---|
| 2,131,308 | 9/1938 | Blumner | 44/51 |
| 2,590,733 | 3/1952 | Stillman | 44/51 |
| 4,248,691 | 3/1981 | Eisenlohr | 208/8 LE |

FOREIGN PATENT DOCUMENTS

| | | | |
|---|---|---|---|
| WO82/02020-57 | 6/1982 | PCT Int'l Appl. | 44/51 |
| 0727274 | 9/1952 | United Kingdom . | |

*Primary Examiner*—Helen M. McCarthy
*Assistant Examiner*—Margaret B. Medley
*Attorney, Agent, or Firm*—Howson and Howson

[57] ABSTRACT

In a process for the production of pumpable coal slurries for use in high-pressure hydrogenation, such an amount of finely divided coal is mixed into an oil which boils at a temperature of higher than about 200° C., as not to exceed the limit of pumpability in respect of the slurry produced. The slurry is treated for about 0.5 to 15 minutes at a temperature of from 280° to 450° C., possibly under elevated pressure. Such a further amount of finely divided coal is mixed into the slurry after the above-indicated treatment, that the limit of pumpability is once again not exceeded. After the addition of the further amount of finely divided coal, the slurry can optionally be subjected again to heat treatment. This mode of operation permits the production of slurries with an elevated coal content, without coking occurring or pumpability being lost when the slurries are heated to hydrogenation temperature.

9 Claims, No Drawings

PROCESS FOR THE PRODUCTION OF PUMPABLE COAL SLURRIES

This application is a continuation of application Ser. No. 406,247 filed Aug. 4, 1982 now abandoned.

FIELD OF THE INVENTION

This invention relates to a process for the production of pumpable coal slurries which are provided for use in a high-pressure hydrogenation operation, with a content of finely divided coal in high-boiling oils which originate in particular from high-pressure hydrogenation.

CHARACTERISTICS OF THE KNOWN TECHNICAL SOLUTIONS

It is known for the hydrogenation of coal to be carried out using slurries of coal in high-boiling oil fractions which originate from the hydrogenation of coal. In order to produce such slurries, finely divided coal is mixed with the oil for example at a temperature of from 100° to 150° C. In this connection, care should be taken to ensure that the amount of coal which is formed into a slurry in the oils is only such that the resulting mixture remains pumpable so that it can be raised to the hydrogenation pressure which is generally higher than about 150 bars. In addition, it should be noted that, when the slurry is heated to the hydrogenation temperature which is generally higher than about 400° C., the viscosity of the slurry rises rapidly due to swelling of the particles of coal so that it can exceed the limit of the range within which the slurry is still pumpable. In order to prevent that from happening and also in order to reduce the danger of coking when it is heated, the proportion of coal in the slurry must generally be limited to about 45% by weight, depending on the quality of the coal used. Attempts have been made to produce higher levels of concentration of coal, while still being pumpable, by heating the flow of coal and the oil separately to temperatures of from about 350° to 400° C., and only then mixing them (German patent specification No. 1 018 406).

That process is very expensive because of the long mixing times of from 2 to 14 hours and also for reasons relating to the equipment required for carrying the process into effect. In addition, depending on the kind of coal used, in particular when using brown coal or lignite, there is the danger that ageing of the coal molecule may occur in that procedure whereby the number of sites at which the hydrogen attack can preferentially occur is reduced.

OBJECT OF THE INVENTION

The invention is based on the problem of avoiding the above-depicted difficulties in order easily to be able to produce slurries with high goal contents, without coking occurring or without exceeding the limit of the range within which the slurries are pumpable, when heated to hydrogenation temperature.

STATEMENT OF THE ESSENCE OF THE INVENTION

To solve this problem, the invention proposes that such an amount of finely divided coal is mixed into an oil which boils at a temperature of higher than about 200° C., as not to exceed the limit of pumpability in respect of the slurry produced, the slurry is treated for a period of from about 0.5 to 15 minutes at a temperature of from 280° to 450° C., possibly under elevated pressure, and such a further amount of finely divided coal is mixed into the slurry after the above-indicated treatment, that once again the limit of pumpability is not exceeded.

If necessary, the coal used, preferably brown coal or lignite, is pre-dried in the usual manner, and finely ground. The oil used for producing the coal slurry is advantageously oil fractions which are produced in the liquefaction of coal, such as middle and heavy distillates or distillation residues. The mixing operation is desirably effected at elevated temperatures, from about 50° to 250° C. Depending on the kind of coal used and the oil used for producing the mixture, the mixtures produced generally have a coal content of from about 30 to 35% by weight and in particularly cases up to about 45% by weight, as the pumpability of the mixtures is no longer sufficient at higher levels of concentration.

According to the invention, the mixtures are maintained at a temperature of from about 280° to 450° C., advantageously from 350° to 400° C., for about 0.5 to 15 minutes, preferably 0.5 to 5 minutes, and gases which are formed for example by decarboxylation such as CO, $CO_2$ and water vapour can be removed from the process. The heat treatment is advantageously carried out under elevated pressure, for example at a pressure of from 3 to 15 bars, possibly also under the pressure of the hydrogenation operation. After the heat treatment, further amounts of coal are added to the slurry, in which respect it is possible to give a level of concentration of coal of more than 50% by weight, for example 60% by weight, without the coal slurry losing its pumpability. It may be advantageous for the slurry to be cooled after the heat treatment, before adding further coal, for example to a temperature of 150° C., and a further heat treatment can also be carried out after the further addition of coal. If desired, it is also possible to operate with more than two stages, when adding the coal. For example, a part flow from the first heat treatment may be circulated, with the further coal being added to that flow. The catalyst required for subsequent hydrogenation of the coal, and also hydrogen, can be added at any right point in the process. The highly concentrated coke/oil slurry is passed into the hydrogenation operation in the usual manner.

EMBODIMENT 2100 g of heavy oil in the boiling range of from 400° C. to 500° C. was mixed with 1700 g of pre-dried Rhineland brown coal or lignite, with a water content of 12% by weight. The mixture was then heated at a temperature of 380° C. under a pressure of 5 bars, with constant agitation. In that operation, 326 g of water and carbon oxides were driven out of the mixture. After 2 minutes, the mixture was cooled to about 100° C. The viscosity of the mixture was then reduced such that a further amount of 1705 g of the above-mentioned brown coal or lignite could be added, without exceeding the limit of pumpability. The mixture which now contained 59.8% coal could be hydrated without difficulty at a pressure of 280 bar and a temperature of 475° C., after the addition of a usual hydrogenation catalyst comprising 'Bayermasse' (Bayer material) and sulphur. Therefore, the heat treatment according to the invention had not reduced the hydrogenation activity of the coal.

We claim:

1. A process for the production of pumpable coal slurries in oils which boil at a temperature of higher than about 200° C., characterized in that a first amount of finely divided coal is mixed into an oil which boils at a temperature of higher than about 200° C. to produce a slurry, the proportion of coal in said slurry being such as not to exceed the limit of pumpability, the slurry is treated for a period of from about 0.5 to 15 minutes at a temperature of from 280° to 450° C., and such a further amount of finely divided coal is mixed into the slurry after the above-indicated treatment as to increase the proportion of coal in the slurry without exceeding the limit of pumpability.

2. A process according to claim 1 characterised in that the oil used originates from the high-pressure hydrogenation of coal and boils at a temperature of from 300° to 500° C.

3. A process according to claim 1 characterized in that, after the addition of the further amount of finely divided coal, the slurry is again subjected to a heat treatment.

4. A process according to claim 2 characterized in that, after the addition of the further amount of finely divided coal, the slurry is again subjected to a heat treatment.

5. A process according to claim 1, 2, 3 or 4 characterized in that the gases and vapors formed are removed from the process in and/or after the heat treatment.

6. A process according to claim 1 or 2 or 3 or 4 in which the step of treating the slurry for a period from about 0.5 to 15 minutes at a temperature of from 280° to 450° C. is carried out under elevated pressure.

7. A process according to claim 1 or 2 or 3 or 4 in which the step of mixing a further amount of finely divided coal into the slurry is followed by passing the slurry into a high pressure hydrogenation operation.

8. A process according to claim 1 or 2 or 3 or 4 in which the step of treating the slurry for a period from about 0.5 to 15 minutes at a temperature of from 280° to 450° is carried out under elevated pressure, and in which the step of mixing a further amount of finely divided caol into the slurry is followed by passing the slurry into a high pressure hydrogenation operation.

9. A process according to claim 1 in which the quantity of said further amount of coal is such that the proportion of coal in the slurry following the addition of said further amount would have exceeded the limit of pumpability if all of the coal in the slurry were mixed with the oil in the slurry in a single mixing step at any temperature up to 250° C.

* * * * *

UNITED STATES PATENT AND TRADEMARK OFFICE

CERTIFICATE OF CORRECTION

PATENT NO. : 4,494,960

DATED : January 22, 1985

INVENTOR(S) : Wilfried Dolkemeyer; Karl-Heinz Keim; Ewald Meisenburg

It is certified that error appears in the above-identified patent and that said Letters Patent are hereby corrected as shown below:

Column 1, line 57, "goal" should be --coal--

Column 2, line 61, "59.8%" should be --58.8%--

Column 2, line 63, "bar" should be --bars--

Column 4, line 17, "caol" should be --coal--

Signed and Sealed this

*Twenty-third* Day of *July 1985*

[SEAL]

*Attest:*

DONALD J. QUIGG

*Attesting Officer* *Acting Commissioner of Patents and Trademarks*